United States Patent [19]

Jones et al.

[11] 4,036,148

[45] July 19, 1977

[54] VEHICLE AND TRACK SYSTEM

[75] Inventors: Vercoe C. Jones; Robert A. Hale, both of Easton, Pa.

[73] Assignee: SI Handling Systems, Inc., Easton, Pa.

[21] Appl. No.: 629,242

[22] Filed: Nov. 6, 1975

[51] Int. Cl.[2] ..... B61B 13/12

[52] U.S. Cl. ..... 104/166; 214/84; 296/3

[58] Field of Search ..... 104/165, 166, 167; 214/84; 296/3

[56] References Cited

U.S. PATENT DOCUMENTS

| | | | |
|---|---|---|---|
| 2,813,642 | 11/1957 | Fisher | 214/84 |
| 3,842,752 | 10/1974 | Harwick | 144/166 |
| 3,854,410 | 12/1974 | Crowder | 104/167 X |

FOREIGN PATENT DOCUMENTS

| | | | |
|---|---|---|---|
| 8,954 | 8/1889 | United Kingdom | 104/166 |

*Primary Examiner*—Robert J. Spar
*Assistant Examiner*—George F. Abraham
*Attorney, Agent, or Firm*—Seidel, Gonda & Goldhammer

[57] ABSTRACT

A track system is arranged to be flush with the floor and a drive shaft is mounted for rotation beneath the level of the floor. A vehicle mounted on wheels is moved along the tracks by a drive wheel which extends downwardly from the bottom of the vehicle through an elongated slot in the floor and which contacts the drive shaft. The vehicle includes a bumper system which upon impact oscillates the drive wheel into a position which decellerates and stops the vehicle. A cam associated with the drive wheel selectively cooperates with a cam surface located beneath the floor level at a queuing station for oscillating the drive wheel into a position which decellerates and stops the vehicle. Means are also provided at the queuing station for positively holding the vehicle in a stopped position.

16 Claims, 5 Drawing Figures

VEHICLE AND TRACK SYSTEM

BACKGROUND OF THE INVENTION

This invention relates to a vehicle and track system of the type classified in Class 104. The types of systems involved herein are exemplified by U.S. Pat. No. 3,356,040 and U.S. Pat. No. 3,818,837.

While these prior art systems have been quite satisfactory for some installations, they do have several drawbacks. One of the primary problems is one of safety in that the rails upon which the vehicles ride, the drive motors, queue stations, and other system equipment are exposed. In such prior art installations, there is a safety hazard if it is desired to provide for pedestrian or vehicle traffic in a direction transverse to the direction of the tracks. In addition, such prior systems were not be particularly aesthetically or architecturely pleasing.

This invention is directed to a driverless vehicle and track system wherein the tracks or rails are arranged to be flush with a support surface such as the floor. The vehicle drive shaft is mounted for rotation beneath the level of the floor and between the tracks. A vehicle mounted on wheels is moved along the tracks by a drive wheel. The drive wheel is supported by a shaft means which extends downwardly from the bottom of the vehicle through an elongated slot in the floor on the center line of the system. The periphery of the drive wheel contacts the periphery of the drive shaft to propel the vehicle. A cam associated with the drive wheel cooperates with a cam surface located beneath the floor level at a queuing station for oscillating the drive wheel about an upright axis into a position which decellerates and stops the vehicle. The vehicle may include a bumper system which upon impact also oscillates the drive wheel into a position which decellerates and stops the vehicle.

It is an object of the present invention to provide a novel vehicle and track system.

It is another object of the present invention to provide a novel vehicle and track system which is aesthetically and architecturely pleasing.

It is another object of the present invention to provide a novel vehicle and track system which is constructed in such a manner that it does not result in a safety hazard to persons in the operating area. It is a still further object of the present invention to provide a novel vehicle and track system wherein all of the operating and control equipment for the system are located beneath the floor level.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
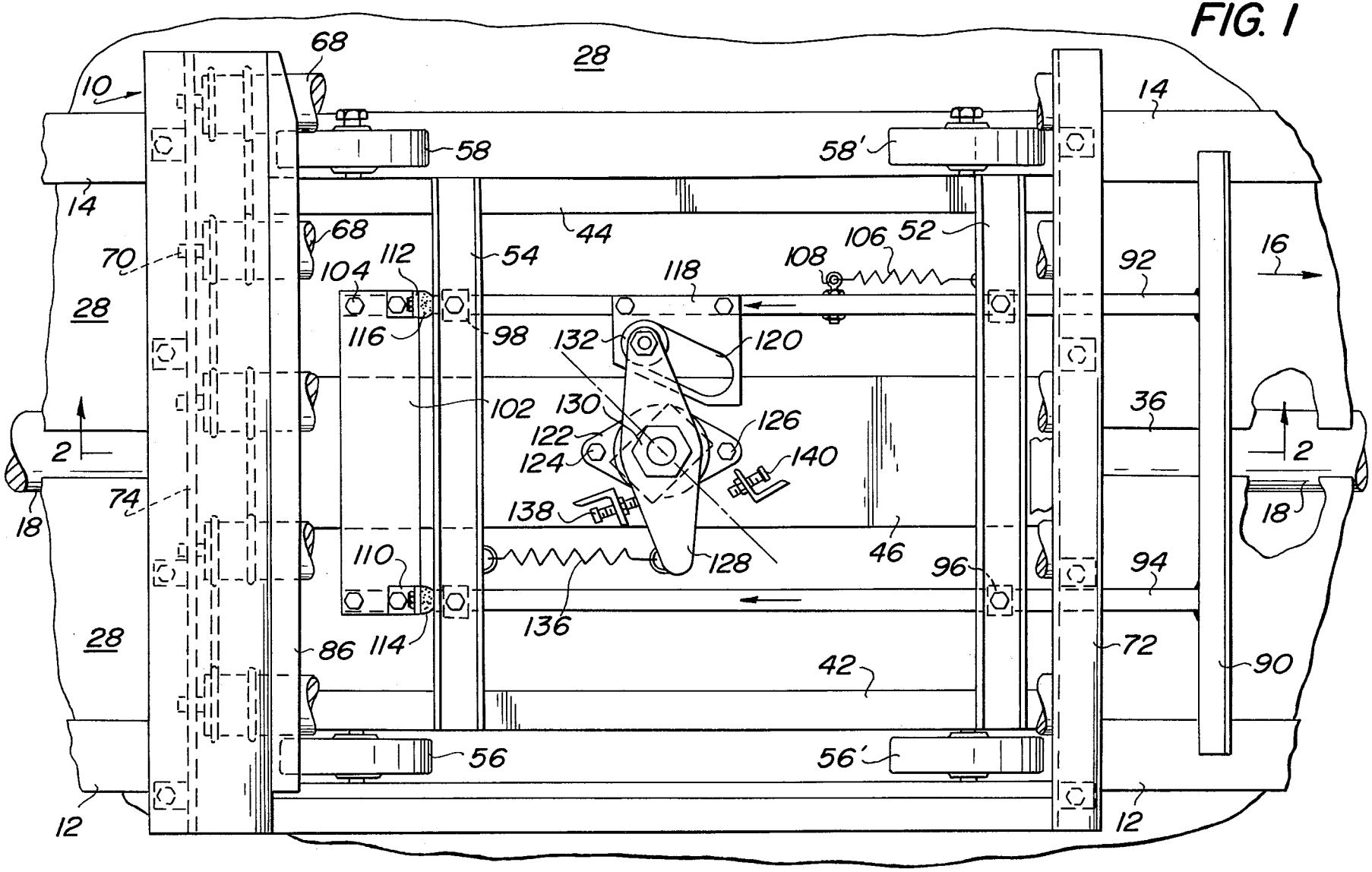
FIG. 1 is a top plan view, partially broken away, of a vehicle and track system is accordance with the present invention.
Figure 2:
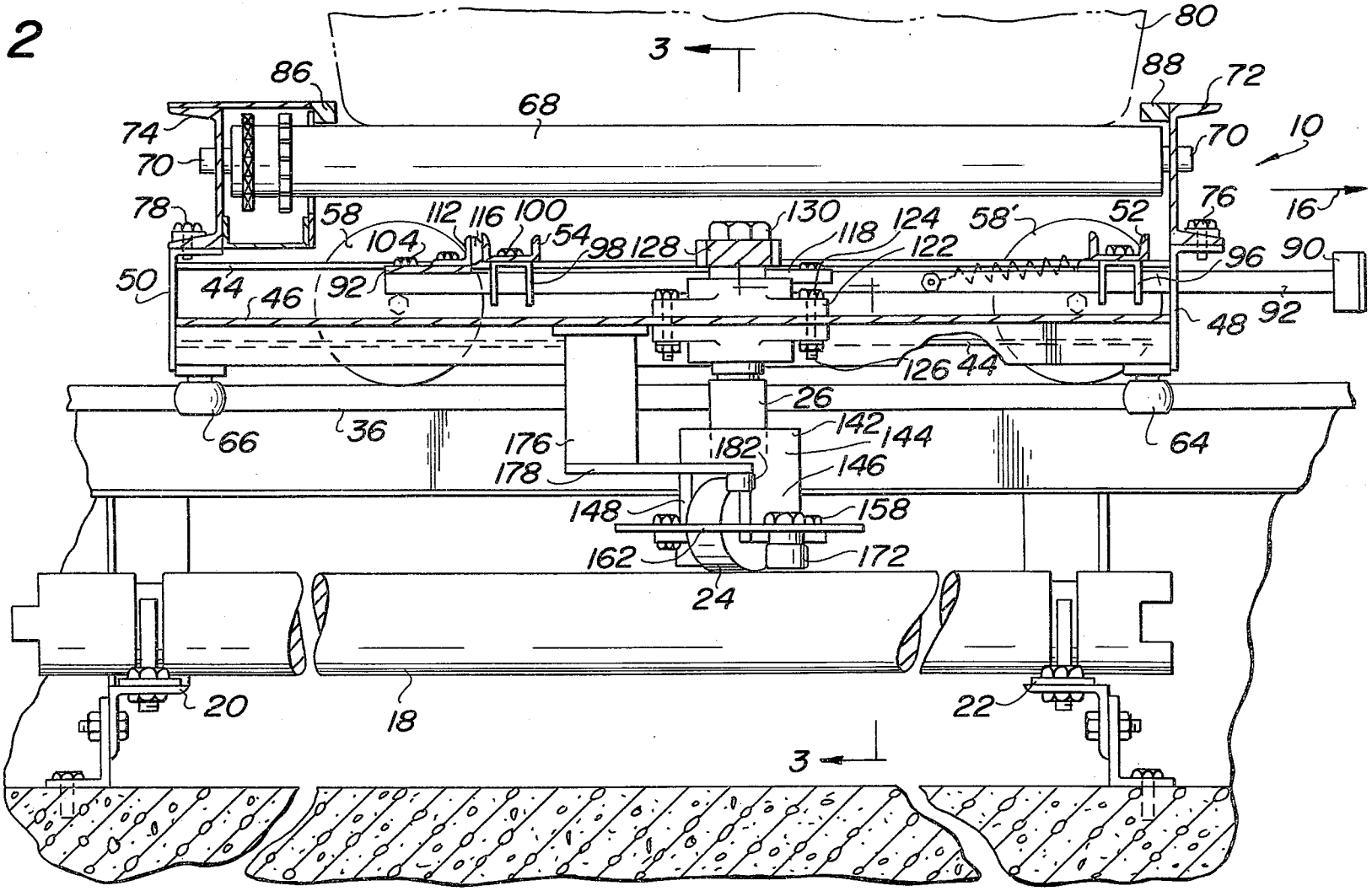
FIG. 2 is a sectional view taken along the line 2—2 in FIG. 1.
Figure 3:
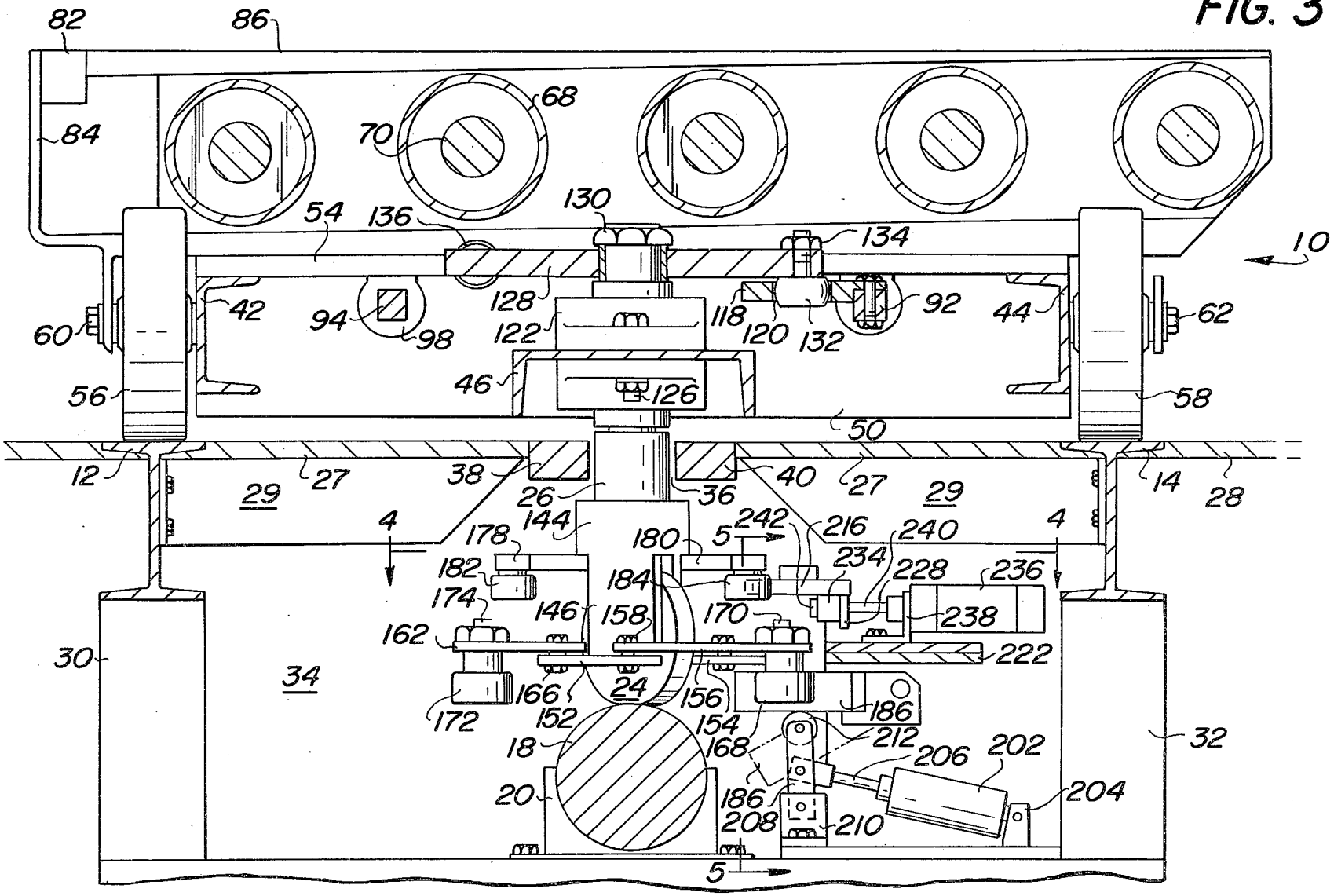
FIG. 3 is a sectional view taken along the line 3—3 in FIG. 2.

Referring to the drawings in detail, wherein like numerals indicate like elements, there is shown in FIGS. 1, 2 and 3 a vehicle and track system in accordance with the present invention. The vehicle is designated generally as 10 and is adapted to ride along tracks 12 and 14 of the system. In FIG. 1, the vehicle 10 is driven in the direction of arrow 16 by means of drive shaft 18. Drive shaft 18 is rototably driven for rotation about its longitudinal axis by means of a reversible motor not shown. The drive shaft 18 is comprised of a plurality of axially aligned tubular sections supported for rotation by a plurality of suitable bearings such as shown at 20 and 22. The rotary movement of the drive shaft 18 is converted into longitudinal movement of the vehicle 10 by interaction of the drive shaft 18 with drive wheel 24 mounted on the vehicle.

In a manner to be more fully described hereinafter, drive wheel 24 is mounted for rotation about a horizontal axis. When the axis of rotation of drive wheel 24 is parallel to the axis of drive shaft 18, there in no movement of the vehicle 10 in the direction of arrow 16. The drive wheel 24 is supported on the bottom side of the vehicle 10 by means of a shaft 26 and is spring biased to the position shown in FIGS. 1, 2 and 3 wherein the axis of rotation of the wheel 24 is at an acute angle of approximately 35°–45° with respect to the longitudinal axis of drive shaft 18. In this position, the vehicle 10 is driven longitudinally in the direction of the arrow 16.

As shown best in FIG. 3, the upper surfaces of tracks 12 and 14 are arranged to be flush with an actually form the continuation of a support surface or floor 28. Tracks 12 and 14 are comprised of I-beams mounted on supports 30 and 32 respectively. Floor 28 is provided with a hollow channel 34 within which is mounted supports 30, 32, the drive shaft 18, and various elements for controlling the operations of the vehicles 10 which will be described more fully hereinafter.

A continuous elongated slot 36 in the floor 28 substantially on the center line of the system between track 12 and 14 accommodates the shaft 26 extending downwardly from the vehicle 10. Access to channel 34 is attained by removable plates 27 at spaced locations. Plates 27 are supported flush with floor 28 by brackets 29 on tracks 12, 14. The slot 36 may be lined on either side with a material such as shown at 38 and 40 for reducing wear caused by guide followers 64 and 66 rubbing against the sides of the slots 36 as the vehicle 10 is moved.

The vehicle is comprised essentially of a frame having side longitudinally extending support beams 42 and 44 and a central longitudinally extending support beam 46. A front laterally extending plate 48 joins the front ends of the support beams 42, 44 and 46 and similarly a rear laterally extending plate 50 joins the rear ends of the support beams. In addition, cross braces 52 and 54 extend between and are rigidly connected to the side support beams 42 and 44.

The vehicle 10 is provided with four wheels 56, 56′, 58, 58′ which are mounted to the outsides of side support beams 42 and 44 by suitable axles such as shown at 60 and 62. Wheels 56, 56′, 58 and 58′ are adapted to ride on the upper surfaces of tracks 12 and 14. In order to guide the vehicle 10 and maintain the wheels on the tracks 12 and 14, the vehicle is provided with a pair of downwardly depending guide followers 64 and 66. Guide follower 64 is mounted adjacent the front of the vehicle 10 substantially along the center line thereof and similarly guide follower 66 is mounted at the rear of the vehicle adjacent the center line. Guide followers 64 and 66 extend into the slot 36 and have a diameter slightly smaller than the width of slot 36. Followers 64, 66 rotate about a vertical axis and are adapted to guide the vehicle 10 as it is moved.

A plurality of conveyor rollers 68 are mounted on top of the vehicle frame for ease of loading and unloading. Rollers 68 have suitable axles 70 journaled into front beam 72 and rear beam 74. Front beam 72 and rear beam 74 are, in turn, rigidly secured to front and rear plates 48 and 50, respectively, of the vehicle frame through suitable bolts such as shown in 76 and 78. As seen in FIG. 3, the plurality of conveyor rollers 68 are arranged such that the rollers closest to the left side of the vehicle 10 (as viewed in FIG. 3) are slightly lower than the rollers to the right side. As a result, when a load such as a box 80 is placed on the vehicle, it rolls down the conveyor rollers 68 until it hits the stop 82 at the left side wall 84. Front and back walls 86 and 88 help guide the box 80 on the conveyor rollers and help maintain the box in position. Thus, it can be seen that even thought the top carrying area of the vehicle 10 is open on three sides, the box 80 will not work itself off the vehicle 10 by vibration when the vehicle is in motion. This eliminates the need for roll breaks or other similar mechanisms. With this construction, loading and unloading is preferably accomplished from the right side as shown in FIG. 3.

A bumper system, carried by the vehicle 10, decellerates and stops the vehicle whenever it comes into contact with another vehicle or any other obstacle in its path. The bumber system includes a laterally extending bumper 90 positioned forwardly of the vehicle. The bumper 90 is supported by longitudinally extending rods 92 and 94 which pass through suitable openings in the front plate 48, front slide bearings blocks 96 and rear slide bearing blocks 98. The bearing blocks 96 and 98 are secured to the front and rear support braces 52 and 54, respectively, through bolts such as shown at 100. A connecting plate 102 is securely fastened to rods 92 and 94 through bolts 104. Bumper 90 is biased outwardly toward the forward direction of the vehicle 10 by a spring 106 connected between front support brace 52 and a bolt 108 secured to rod 92. Forward movement of bumper 90 is limited by a pair of L-shaped stop elements 110 and 112 secured to the connecting plate 102 and which are adapted to abut rear support brack 54 when bumper 90 is in its forwardmost position. Resilient means such as at 114 and 116 are provided between stop members 110 and 112 and rear support brace 54. Rod 92 also carries a cam plate 118 having an elongated opening 120 therein which is formed at an angle with respect to the longitudinal axis of the vehicle.

As stated above, drive wheel 24 is carried by shaft 26 so that the wheel 24 can be oscillated about a vertical axis. It can be seen in FIGS. 2 and 3 that shaft 26 is rotatable secured to central support beam 46 through a bearing 122. Bolts 124 and 126 securely fasten bearing 122 to the central support beam 46. Shaft 26 extends above bearing 122. A two-side control lever 128 is rigidly fastened to the upper extension of the shaft 26 by a nut 130.

A cam follower 132 is rotatably mounted to one end of control lever 128 by bolt 134 and extends downwardly from lever 128 into slot 120 of cam plate 118. A spring 136 is connected between the other end of control lever 128 and the rear support brace 54 so as to bias the control lever 128 for clockwise rotation as viewed in FIG. 1. A suitable stop means in the form of a screw 138 prevents clockwise rotation of control lever 128 past the position shown in FIG. 1 and a similar adjustable stop means in the form of a screw 140 limits the counterclockwise movement of control lever 128.

The bumper system functions as follows. Since spring 136 biases control lever 128 and hence drive wheel 24 in the position shown in FIG. 1, rotation of drive shaft 18 results in movement of the vehicle 10 in the direction shown by arrow 16. Upon impact with another vehicle or some other obstacle in its course, bumper 90 moves rearwardly against the tension of spring 106 and carries with it cam plate 118. Cam follower 132 riding in slot 120 also moves rearwardly causes counterclockwise rotation of control lever 128 as viewed in FIG. 1. Since control lever 128 is rigidly secured to shaft 26, counterclockwise movement of control lever 128 oscillates drive wheel 24 in the counterclockwise direction until the axis of drive wheel 24 is parallel with the axis of drive shaft 18. Adjustable stop means 140 is adjusted so that control lever 128 cannot be rotated past the position where the axis of drive wheel 24 is parallel with the axis of drive shaft 18. In this position, rotation of drive shaft 18 does not impart movement to the vehicle 10 in the direction of arrow 16 and the vehicle stops.

The vehicle 10 can also be stopped at desired queuing stations strategically spaced throughout the system. At the queuing stations, the vehicles are decellerated, stopped and positively held in the stop position primarily by the cooperation of cams and cam followers to be described below.

The lower end of shaft 26 is provided with a yoke member 142 having an upper section 144 and a pair of spaced apart downward projections 146 and 148. Set screw 150 rigidly secures yoke member 142 to shaft 26 so that movement of one causes movement of the other. Drive wheel 24 is rotatably mounted on an axle, not shown, extending between downward projections 146 and 148 of yoke 142. Horizontally disposed plates 152 and 154 are rigidly secured to the bottom of projections 146 and 148 and extend outwardly away from drive wheel 24. An arcuately shaped cam plate 156 extends between plate 152 and 154 and is rigidly secured thereto through bolts 158 and 160. Similarly, an arcuately shaped cam plate 162 extends between plate 154 and plate 152 and is rigidly secured thereto through bolts 164 and 166, respectively. A cam follower 168 is secured to cam plate 156 through a bolt 170 and depends downwardly therefrom. Similarly, cam follower 172 is secured to cam plate 162 by a bolt 174 and depends downwardly therefrom.

The vehicle 10 also includes a post 176 which is secured to the central beam 46 adjacent the longitudinal center thereof and slightly to the rear of bearing 122. Post 176 depends downwardly through slot 36 and carries a horizontally disposed V-shaped plate having arms 178 and 180. Arms 178 and 180 extend toward the front of the vehicle 10 and terminate substantially at the center line thereof on either side of shaft 26. A cam follower 182 extends downwardly from the end of arm 178 and a cam follower 184 extends downwardly from the end of arm 180.

Each queuing station includes a cam element 186 with a straight central cam surface 188 parallel to shaft 18 and outwardly inclined surfaces 190 and 192 extending from the central surface 188 to provide for gradual smooth acceleration and deceleration. The ends of cam element 186 are pivotally mounted to upright supports 194 and 196 through bolts 198 and 200 so that cam element 186 can be moved between its full upright position as shown in solid lines in FIG. 3 and its full downward position as shown in phantom in FIG. 3.

Cam element 186 is moved into its upright, operative position by an air cylinder 202 which is pivotally connected to a bracket 204. The piston rod 206 of air cylinder 202 is pivotally connected to the center of a forked lever 208 which has its bottom end pivoted to a bracket 210. A roller 212 is rotatably mounted at the upper end of forked lever 208 between the two forks thereof. When piston rod 206 of air cylinder 202 is retracted, forked lever 208 moves clockwise as viewed in FIG. 3 thereby lowering cam element 186. Similarly, when the piston rod 206 of air cylinder 202 is extended, lever 208 rotates counterclockwise as viewed in FIG. 3 and forces cam element 186 upwardly into its operative position.

Mounted above cam element 186 at a level substantially even with cam followers 182 and 184 are a pair of cam elements 214 and 216. Cam elements 214 and 216 are horizontally arranged but are mounted to pivot about vertical axes through bolts 218 and 220 secured to frame 222. Frame 222 is mounted on a platform 224 which is secured to upright supports 194 and 196. See FIG. 5.

Figure 4:
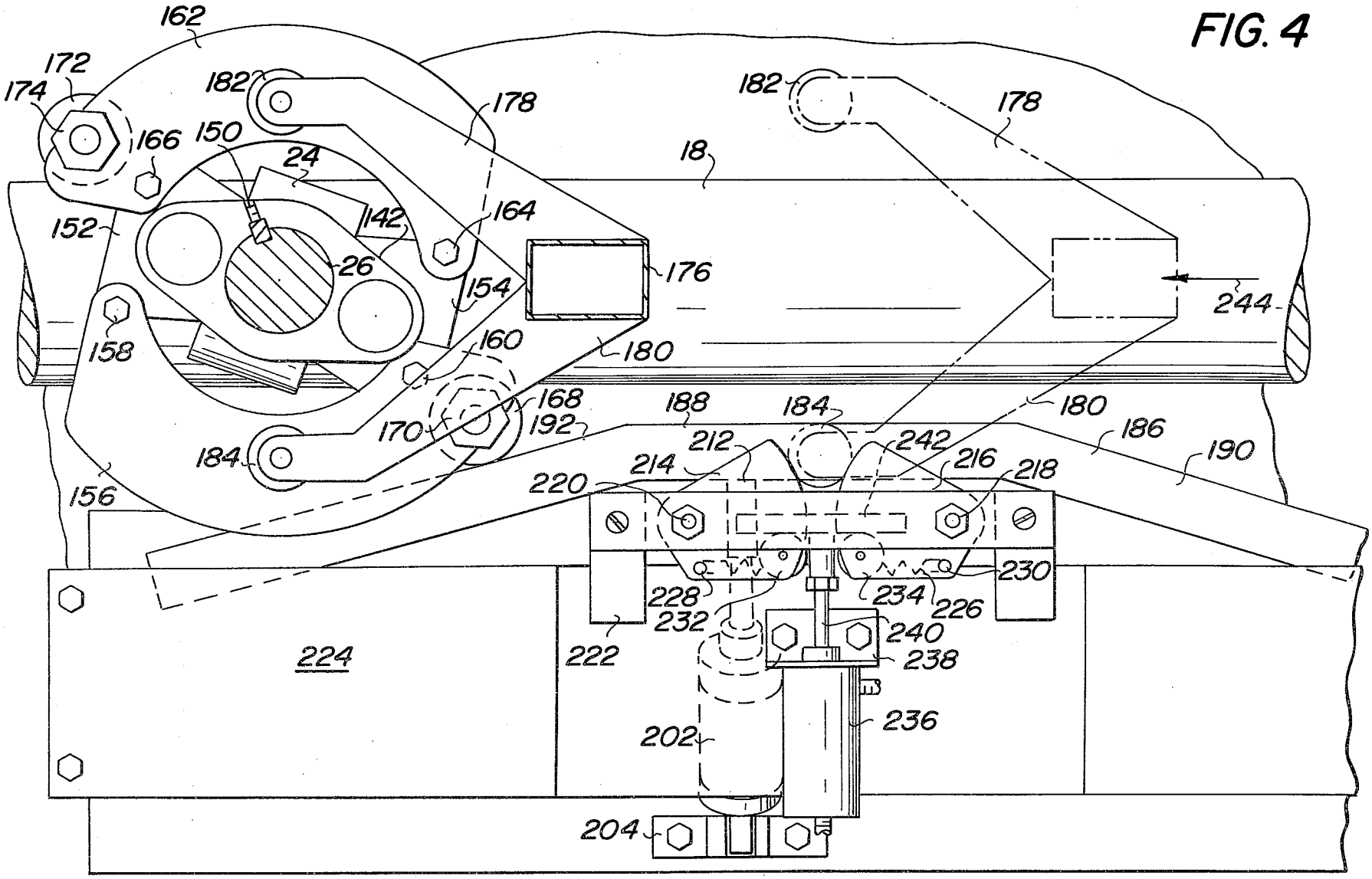
FIG. 4 is a sectional view, on an enlarged scale, taken along the line 4—4 in FIG. 3.

Cam elements 214 and 216 are biased into the operative position shown in FIG. 4 by a spring 226 extending between posts 228 and 230 depending downwardly from cam elements 214 and 216, respectively. Also depending downwardly from cam elements 214 and 216 are cam followers 232 and 234. An air cylinder 236 mounted to platform 222 through bracket 238 has its piston rod 240 extending between cam followers 232 and 234. A cross bar 242 extends outwardly on either side of piston rod 240 and engages cam followers 232 and 234.

When piston rod 240 of air cylinder 236 is fully extended, as shown in FIG. 4, cam elements 214 and 216 are biased inwardly toward drive shaft 18 by spring 226 and are in their operative position. When piston rod 240 of air cylinder 236 is retracted, cross bar 242 moves outwardly away from drive shaft 18. Cam followers 232 and 234 follow cross bar 242 outwardly thereby pivoting cam elements 214 and 216 outwardly away from drive shaft 18 and against the tension of spring 226.

The queuing station operates as follows. As a vehicle 10 approaches the queuing station, the cam surface of plate 156 or plate 162 engages and trips a limit switch, not shown, which through an appropriate hydraulic or compressed air system energizes air cylinders 202 and 236 thereby extending their piston rods 206 and 240. It should be noted that since cam plates 156 and 162 are arcuately shaped, they provide the same surface conditions for the actuation of the limit switch regardless of the angular position of the shaft 26. This means that the limit switch will be actuated regardless of the speed at which the vehicle 10 is moving.

Figure 5:
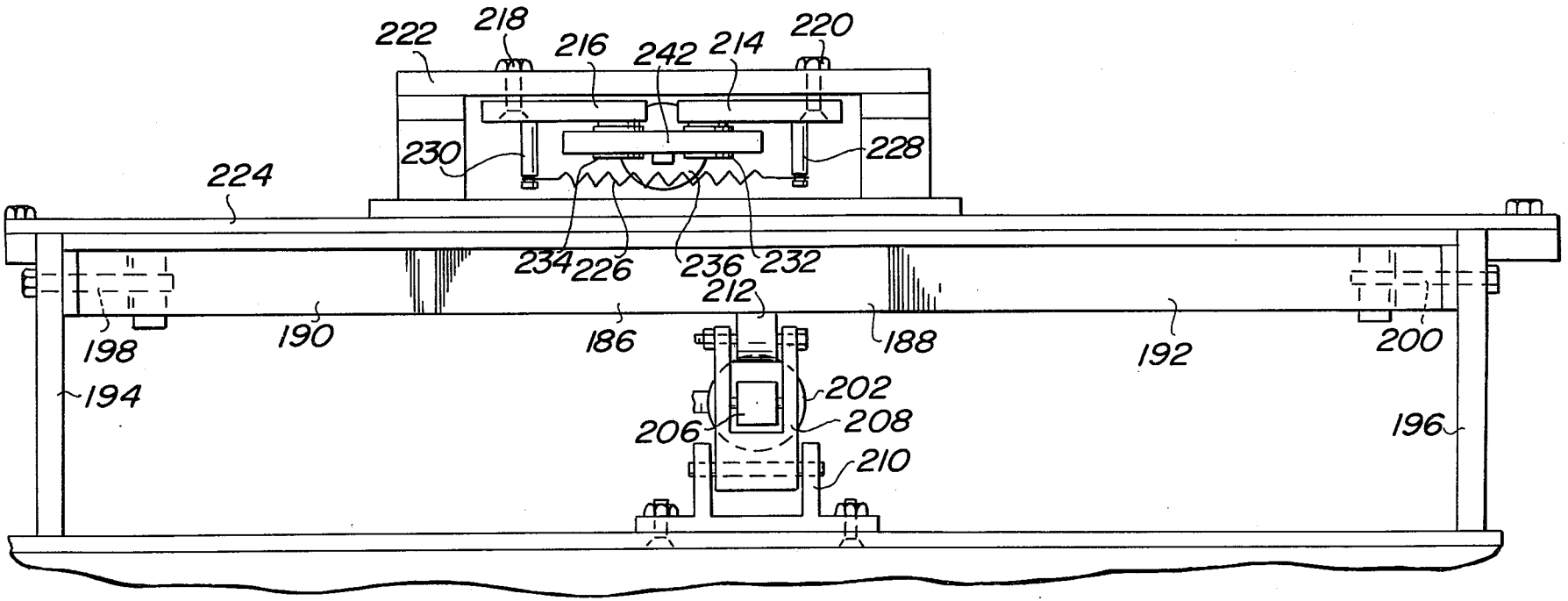
FIG. 5 is a sectional view, on an enlarged scale, taken along the line 5—5 in FIG. 3.

Actuation of air cylinder 202 moves cam element 186 upwardly into the operative position shown in FIG. 5. Actuation of air cylinder 236 allows cam elements 214 and 216 to return to their operative position shown in FIG. 4 as a result of the tension of spring 226. As vehicle 10 continues to approach the queuing station, cam follower 168 engages cam surface 190 and causes shaft 26 and hence drive wheel 24 to oscillate in a counterclockwise position as viewed in FIG. 4. As discussed above, this results in a decelleration of the vehicle 10. As the vehicle continues to move in the direction of arrow 224 in FIG. 4, cam follower 184 engages cam element 216 forcing it outwardly away from drive shaft 18. Eventually, cam follower 184 moves past the inclined surface of cam element 216 and cam element 216 moves back to the position shown in FIG. 4 as a result of the tension of spring 226. In this position, it can be seen that cam follower 184 is held between cam elements 214 and 216. Cam follower 168 is in contact with surface 188 and as a result, the vehicle 10 is positively stopped and latched in such position.

Vehicle 10 resumes its travel by actuating air cylinders 236 and 202 so as to retract their piston rods 240 and 206 sequentially. When this occurs, cam elements 214 and 216 are forced outwardly away from drive shaft 18. Cam follower 184 is thus freed from between cam elements 214 and 216. Vehicle 10 travels in the direction of arrow 244 and drive wheel 24 is biased back to its angular position by spring 136. After cam follower 168 is free of bar 192, cylinder 202 actuates to retract its piston rod 206, thereby lowering cam element 186 downwardly to position shown in phantom in FIG. 3. Actuation of cylinders 236 and 202 in sequence may be manual or automatic by use of a timer device.

While the queuing station has been described as being actuated by air cylinders 202 and 236, other equivalent devices such as solenoids may be used in their place. In addition, the details of the hydraulic or fluid systems for actuating cylinders 202 and 236 have not been specifically described since they will be readily apparent to one of ordinary skill in the art. It should also be readily apparent that the queuing station can be located on either side of drive shaft 18 since the control mechanism including cam plates 156 and 162 and cam followers 168 and 172 and the cam followers 182 and 184 for positively stopping the vehicle 10 are arranged symmetrically about the center line of the system. It should further be readily apparent that the queuing station functions in the same manner to stop a vehicle 10 regardless of the direction in which it is moving.

The present invention may be embodied in other specific forms without departing from the spirit or essential attributes thereof and, accordingly, reference should be made to the appended claims, rather than to the foregoing specification as indicating the scope of the invention.

What is claimed is:

1. A driverless vehicle system comprising a substantially continuous support surface having a channel therebelow, a vehicle mounted on wheels and being adapted to ride on spaced track portions of said support surface, said vehicle having a portion for supporting a load, a guide surface generally flush with said support surface and located between said track portions, said guide surface having an elongated slot in said support surface, an elongated drive shaft means mounted for rotation within said channel and being substantially parallel with said slot, said vehicle including a drive wheel means on the bottom side thereof, said drive wheel means extending downwardly through said slot and including a drive wheel in said channel, said drive wheel being oscillatable about an upright axis and rotatable about a horizontal axis, the periphery of said drive wheel contacting the periphery of said drive shaft means, a control member coupled to said drive wheel for oscillating said drive wheel, said control member being located beneath the level of said support surface and being mounted for oscillation between a vehicle drive position and a vehicle stop position, an actuator means at spaced locations beneath said support surface for selectively oscillating said control member about said upright axis to cause said vehicle to stop, said actuator means being movable between an operative position wherein it can engage said control member for oscillating the same and an inoperative position wherein it cannot engage said control member.

2. A system as claimed in claim 1 including a second control member coupled to said drive wheel for oscillating said drive wheel about said upright axis, said second control member being above the level of said support surface and being mounted on said vehicle for movement between a vehicle drive position and a vehicle stop position.

3. A system as claimed in claim 2 wherein said second control member extends forwardly of said vehicle and includes a bumper means for said vehicle whereby movement of said bumper means rearwardly causes said oscillation of said drive wheel toward its vehicle stop position.

4. A system as claimed in claim 1 further including means positioned beneath said support surface for positively holding said vehicle in a stopped position when said actuator means oscillates said control member to its vehicle stop position.

5. A system in accordance with claim 4 wherein said holding means includes a selectively operable motor means connected to a latch supported at an elevation different from the elevation of said control member, and a rotatable follower on said vehicle at the elevation of said latch, said latch having an operative and an inoperative position, said latch engaging said follower on its operative position for restraining movement of said vehicle.

6. A system in accordance with claim 1 wherein said guide surface includes spaced plates removably supported on brackets disposed in said channel.

7. A system in accordance with claim 1 including a pair of spaced guide members depending from a central portion of said vehicle into said slot for guiding the vehicle along the slot.

8. A system in accordance with claim 1 including removable plates between said track portions and flush with said support surface for providing access to said channel, brackets in said channel and connected to said track portions for supporting said plates.

9. Apparatus comprising a vehicle having a portion for supporting a load, said vehicle being mounted on wheels adapted to ride on a track, drive wheel means on the bottom side of said vehicle and extending downwardly therefrom, said drive wheel means including a drive wheel oscillatable about an upright axis and rotatable about a horizontal axis, a control member having one end coupled to said drive wheel for oscillating said drive wheel about said upright axis, the other end of said control member being free for contact with an actuator, said control member and drive wheel being mounted for oscillation between a vehicle drive position and a vehicle stop position, at least one stop member supported on the bottom side of said vehicle and rigidly connected thereto, said stop member being at an elevation different from the elevation of said control member, said stop member being adapted for cooperation with a latch means for holding the vehicle in a stop position, each of said drive wheel and stop member and control member being entirely below the elevation of the lowermost part of said wheels upon which said vehicle is mounted.

10. Apparatus as claimed in claim 9 including a second control member coupled to said drive wheel for oscillating said drive wheel, said second control member lying above the elevation of the lowermost part of said wheels upon which said vehicle is mounted and said second control member being mounted on said vehicle for movement between a vehicle drive position and a vehicle stop position.

11. Apparatus as claimed in claim 10 wherein said second control member extends forwardly of said vehicle and includes a bumper means for said vehicle whereby movement of said bumper means rearwardly causes oscillation of said drive wheel towards its vehicle stop position.

12. Apparatus in accordance with claim 11 wherein said bumper means is guided for horizontal reciprocable movement by a pair of guide members, said members being on opposite sides of said axis and each member having one end connected to said bumper means, said bumper means extending horizontally generally parallel to the front end of said vehicle and being biased forwardly of the vehicle.

13. Apparatus in accordance with claim 9 including first and second rotatable guide members in a central portion of the vehicle, said first guide member extending downwardly from a front portion of said vehicle, said second guide member extending downwardly from a rear portion of said vehicle, said guide members extending downwardly for a distance which is below the elevation of the lowermost portion of said vehicle wheels so that said guide members can extend into a guide slot for said drive wheel means, said guide members being on opposite sides of said drive wheel means.

14. Apparatus in accordance with claim 9 wherein said load supporting portion includes parallel rollers, the longitudinal axes of said rollers lying in a plane inclined to the horizontal, and a limit stop on said vehicle adjacent the roller having the lowermost longitudinal axis.

15. Apparatus in accordance with claim 14 wherein said rollers rotate about longitudinal axes perpendicular to the axis of rotation of said wheels and generally parallel to the side edges of said vehicle.

16. Apparatus in accordance with claim 9 including a longitudinally extending support channel below the elevation of said load support portion, said channel having a bearing rotatably supporting a shaft, said shaft being part of said drive wheel means and supporting at its lower end said drive wheel, said drive wheel and shaft being oscillatable about said upright axis as a unit.

* * * * *